US007168839B2

(12) United States Patent
Chinniah et al.

(10) Patent No.: US 7,168,839 B2
(45) Date of Patent: Jan. 30, 2007

(54) LED BULB

(75) Inventors: Jeyachandrabose Chinniah, Canton, MI (US); Christopher L. Eichelberger, Livonia, MI (US); Jeffrey Allen Erion, Plymouth, MI (US); John Li, Northville, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 165 days.

(21) Appl. No.: 10/945,321

(22) Filed: Sep. 20, 2004

(65) Prior Publication Data

US 2006/0061990 A1 Mar. 23, 2006

(51) Int. Cl.
*F21V 7/04* (2006.01)

(52) U.S. Cl. ..... 362/555; 362/326; 362/307; 362/296; 362/327

(58) Field of Classification Search ..... 362/545, 362/555, 326, 307, 309, 329, 511
See application file for complete search history.

(56) References Cited

U.S. PATENT DOCUMENTS

| | | | | |
|---|---|---|---|---|
| 2,387,816 | A | 10/1945 | Wagner | |
| 3,593,014 | A | 7/1971 | Vesely | |
| 4,344,110 | A | 8/1982 | Ruediger | |
| 5,608,290 | A | 3/1997 | Hutchisson et al. | |
| 5,642,933 | A | 7/1997 | Hitora | |
| 6,097,549 | A | 8/2000 | Jenkins et al. | |
| 6,356,394 | B1 | 3/2002 | Glienicke | |
| 6,431,738 | B1 | 8/2002 | Kondo et al. | |
| 6,447,155 | B2 | 9/2002 | Kondo et al. | |
| 6,598,998 | B2 * | 7/2003 | West et al. | 362/307 |
| 6,679,618 | B1 | 1/2004 | Suckow et al. | |
| 6,755,556 | B2 * | 6/2004 | Gasquet et al. | 362/329 |
| 6,871,982 | B2 * | 3/2005 | Holman et al. | 362/331 |
| 6,953,271 | B2 * | 10/2005 | Aynie et al. | 362/511 |
| 2002/0080615 | A1 | 6/2002 | Marshall et al. | |
| 2004/0012976 | A1 | 1/2004 | Amano | |
| 2004/0120157 | A1 * | 6/2004 | Bottesch et al. | 362/487 |
| 2004/0141323 | A1 | 7/2004 | Aynie et al. | |

* cited by examiner

*Primary Examiner*—Renee Luebke
*Assistant Examiner*—Zahra I. Bennett
(74) *Attorney, Agent, or Firm*—Brinks Hofer Gilson & Lione

(57) ABSTRACT

A LED bulb and light module utilizes a LED light source and directs light therefrom in a manner which improves efficiency and illumination. Ideally, the LED bulb is structured to create a virtual image whereby the efficiency of light directed out of the module is greatly improved, even with a single LED light source.

23 Claims, 4 Drawing Sheets

LED BULB

FIELD OF THE INVENTION

The present invention relates generally to a light module for a motor vehicle, and more particularly relates to an LED bulb for use in such a light module.

BACKGROUND OF THE INVENTION

Modern automotive light modules typically use a filament bulb as their light source. While such modules have a long and successful history, filament bulbs consume a large amount of power and have a relatively short life. In an attempt to overcome these shortcomings, others have proposed to utilize LED light sources to replace the filament bulbs since LED's consume significantly less power and have a long life span.

Unfortunately, LED solutions also have their drawbacks. In particular, automotive light assemblies utilizing LED light sources typically use a large number LED's, typically eight or more, which thus requires increasing amounts of power over a single LED bulb. Furthermore, these light modules using LED light sources suffer from poor efficiency, that is, the amount of original light from the light source which is actually directed outwardly away from the vehicle to illuminate the surrounding area.

Accordingly, there exists a need to provide an automotive light source which utilizes an LED light source to significantly reduce power consumption, have long life, while at the same time efficiently direct the light to provide adequate illumination.

BRIEF SUMMARY OF THE INVENTION

The present invention provides a LED bulb and light module which utilizes a LED light source and directs light therefrom in a manner which improves efficiency and illumination. Ideally, the LED bulb is structured to create a virtual image whereby the efficiency of light directed out of the module is greatly improved, even with a single LED light source. The LED bulb generally includes a light pipe, a conical reflector, and a plurality of ribs on the outer surface of the light pipe. The light pipe receives light from the LED light source and guides the light downstream along a longitudinal axis defined by the light pipe. The conical reflector redirects the light radially outwardly. The plurality of ribs redirects the light to define a virtual image of the LED light source.

According to more detailed aspects, the LED bulb is plastic molded from a clear optical grade material, whereby the aforementioned components are integrally formed. The conical reflector preferably includes a series of alternating first and second surfaces, the first surface is oriented generally parallel to the longitudinal axis and the second surface is angled relative to the longitudinal axis. The ribs are axial aligned with the second surface of the conical reflector to receive the redirected light. The ribs are axially spaced apart from each other a distance corresponding to the axial distance spanned by each first surface.

The ribs are preferably tapered and have a triangular shape. The downstream side of each rib is angled relative to the longitudinal axis. A set of the upstream ribs may include at least one rib which is shorter than the other ribs. The ribs redirect the light upstream to define the virtual image. An upstream end of the light pipe preferably includes a recess for receiving the LED light source. The upstream end defines a lens adjacent the recess for focusing the light longitudinally downstream. Similarly, the upstream end is structured to collimate light from the LED light source and direct the light longitudinally downstream.

BRIEF DESCRIPTION OF THE DRAWINGS

The accompanying drawings incorporated in and forming a part of the specification illustrate several aspects of the present invention, and together with the description serve to explain the principles of the invention. In the drawings.

DETAILED DESCRIPTION OF THE INVENTION

Figure 1:
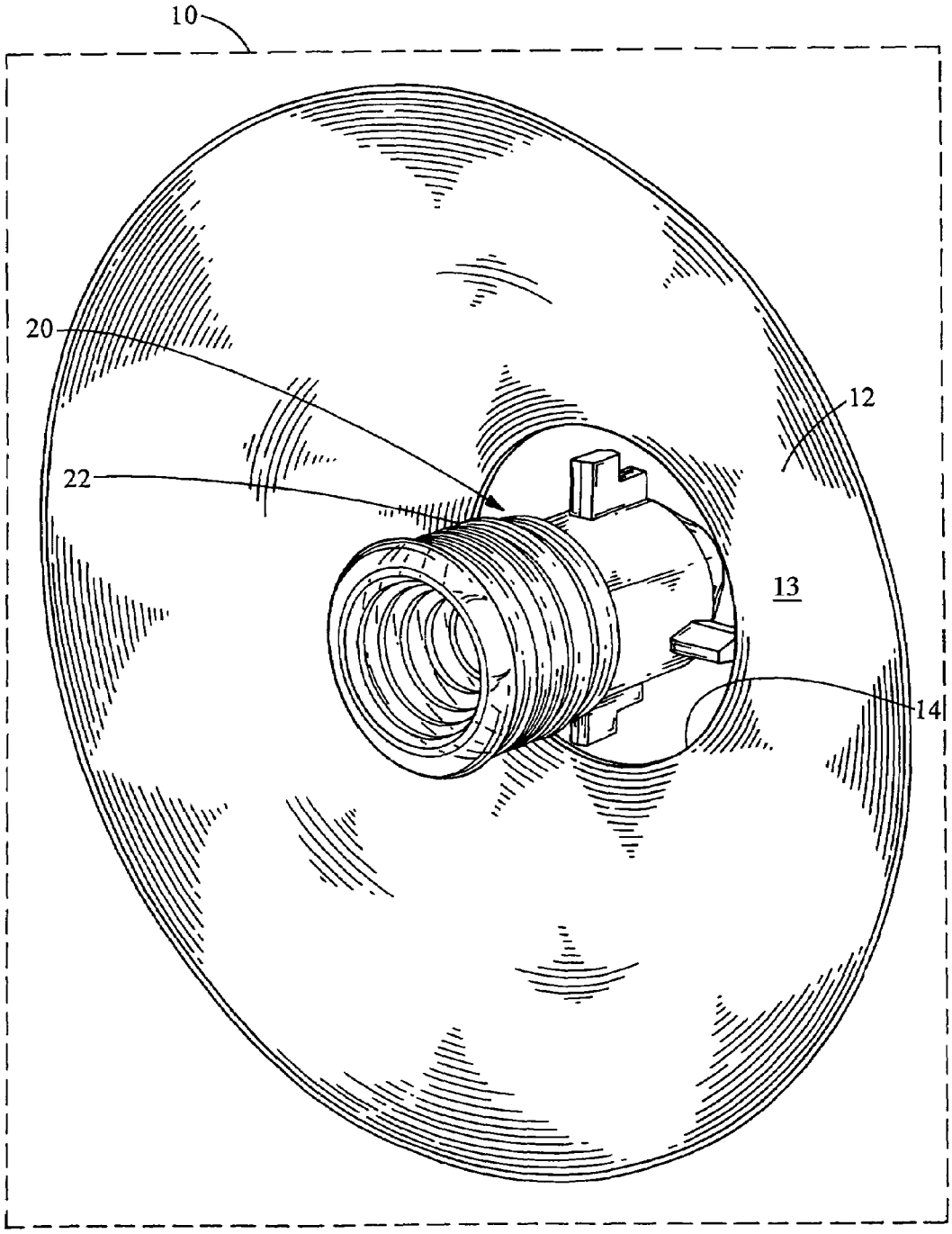
FIG. 1 is a perspective view of an embodiment of a light module for an automobile constructed in accordance with the teachings of the present invention.
Figure 2:
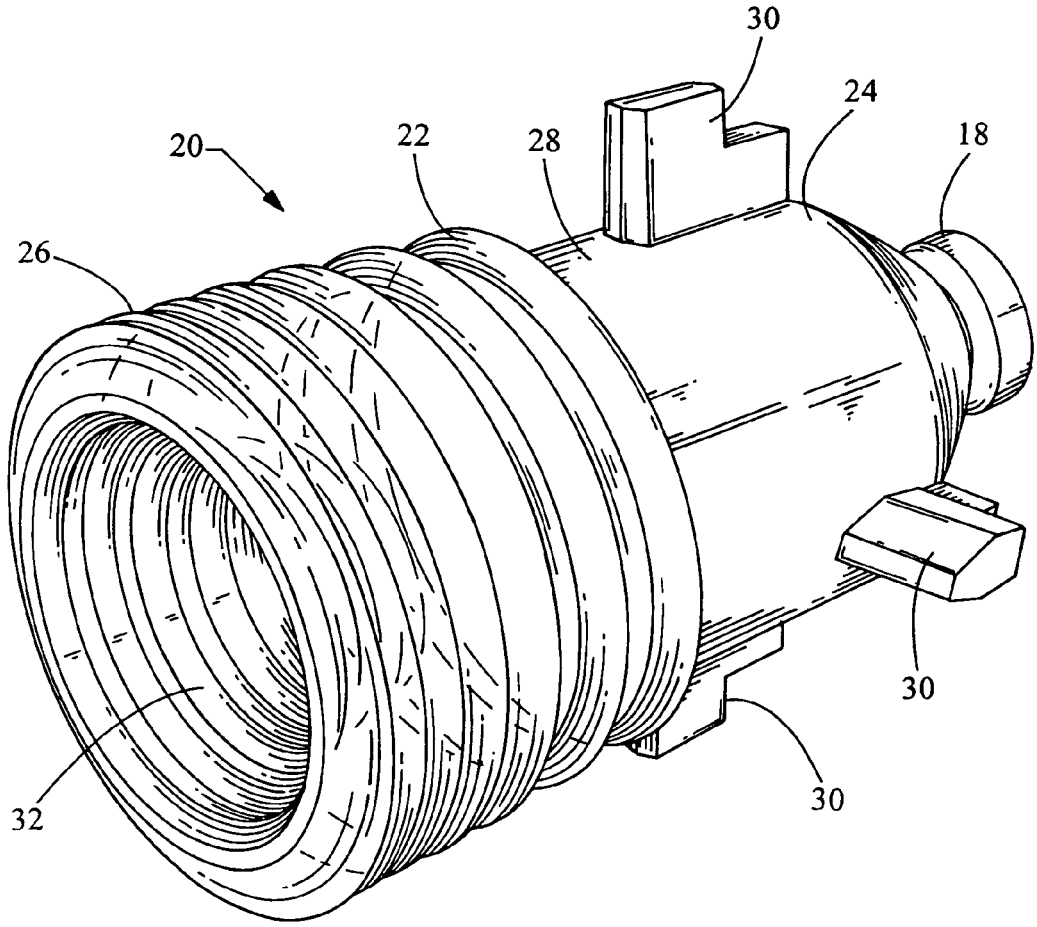
FIG. 2 is a perspective view of an LED bulb forming a portion of the light module depicted in FIG. 1.

Turning now to the figures, FIG. 1 depicts a perspective view of a light module 10 having a LED bulb 20 constructed in accordance with the teachings of the present invention. Among other things, the light module 10 includes a reflector 12 defining a reflective surface 13 which receives light from a source cavity defined by the reflector and directs the light outwardly away from the vehicle. The reflector 12 includes an opening 14 which receives an LED bulb 20. The bulb 20 is generally defines by a light pipe 22 which extends through the opening 14 in the reflector 12. The light pipe 22 directs light received from a LED light source 18 (FIG. 2).

The details of the LED bulb 20 will now be described with reference to FIG. 2. The entire light pipe 22 is generally integrally formed, and preferably is formed by injection molding a clear optical grade material. The material must be capable of conducting light in the visible wave length range, and is preferably a plastic such as acrylic which allows a molding process to be used for producing the part. The light pipe 22 directs the light utilizing the principles of total internal reflection and a number of angled internal surfaces for reflecting and directing the light. The light pipe 22 generally includes an upstream end 24 and a downstream end 26. Light from the LED light source 18 flows downstream from the upstream end 24 to the downstream end 26. A main body 28 of the light pipe 22 is generally cylindrical in nature, and includes a plurality of flanges 30 attached to its outer surface for connecting the LED bulb 20 to the other structural components of the light module 10 or other support structures of the vehicle. The downstream 26 of the light pipe 22 includes a conical reflector 32 for redirecting the light in the light pipe 22 radially outwardly through ribs 50, as will be described in more detail below.

Figure 3:
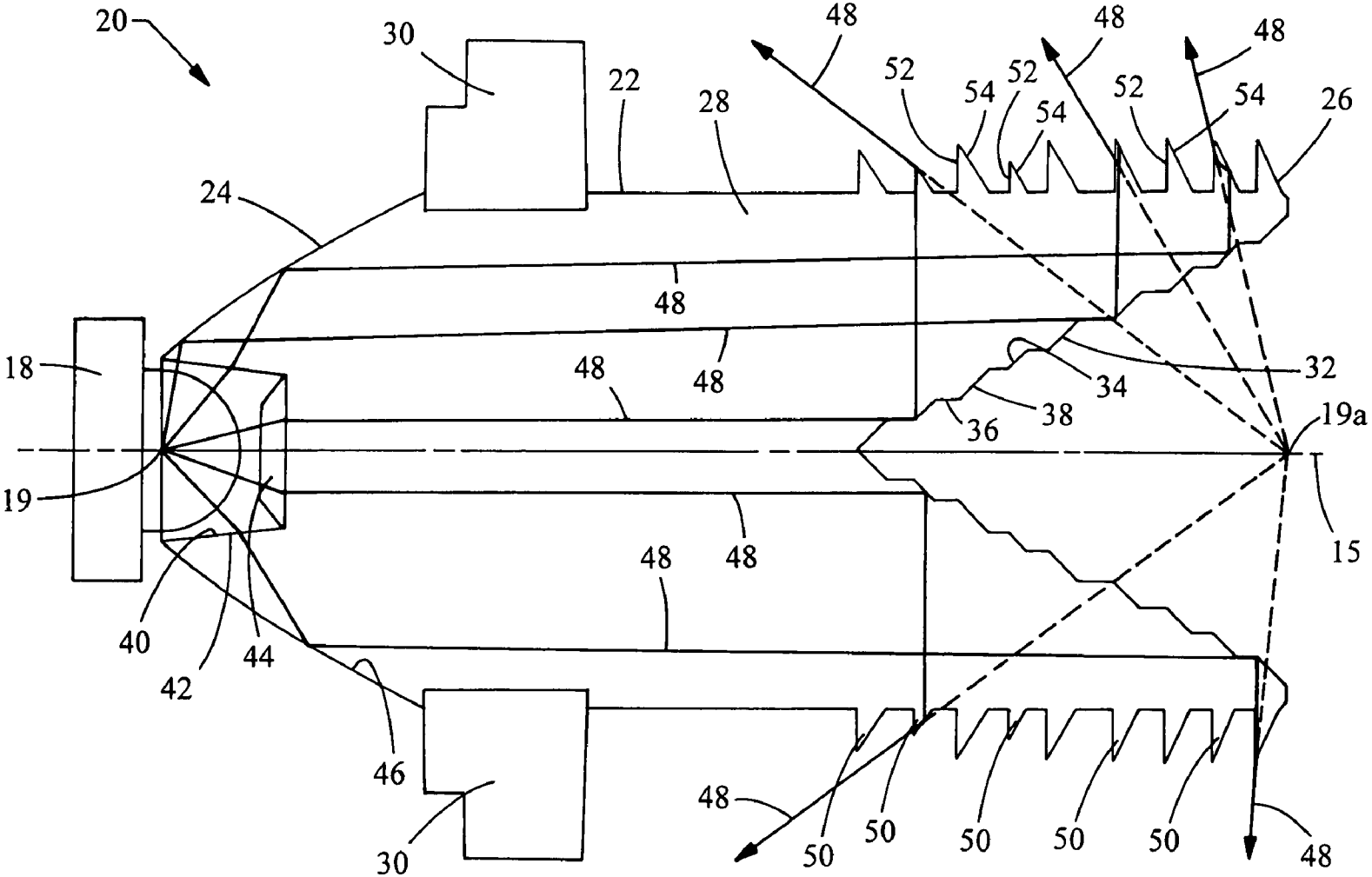
FIG. 3 is a side view of the LED bulb depicted in FIGS. 1 and 2.

As shown in FIG. 3, the conical reflector 32 defines an inner reflective surface 34 that acts as a reflector using the principle of total internal reflection inside the light pipe 22. The inner surface 34 alternates between a first set of surfaces 36 and a second set of surfaces 38. The light pipe 22 defines a longitudinal axis 15, and the first surfaces 36 are generally parallel to the longitudinal axis 15. The second surfaces 38, interspersed between the first surfaces 36, are generally angled relative to the longitudinal axis 15, preferably around 45°.

It will also be seen in FIG. 3 that an outer peripheral surface of the downstream end 26 of the light pipe 22 includes a plurality of ribs 50 projecting radially outwardly. The ribs 50 have a tapered shape, and most preferably have a triangular cross-sectional shape defined by a first upstream face 52 and a second downstream face 54. The upstream face 52 is generally perpendicular (in the range of 85°–90°) to the longitudinal axis 50, while the downstream face 54 is generally angled (in the range of 30°–89°) relative to the longitudinal axis 15. It will be recognized by those skilled in the art that both of the faces 52, 54 can be angled relative to the longitudinal axis 15 (or the relative angling reversed) to achieve the desired effect of directing light outwardly from the light pipe 22 to create a virtual image. The ribs 50 are aligned along the longitudinal axis 15 with the second surfaces 38 of the conical reflector 32. The ribs 50 are axially spaced apart from each other a distance corresponding to the axial distance spanned by each first surface 36. It will be recognized that an upstream set of the ribs 50, namely the first four ribs, alternate between taller ribs and shorter ribs. This allows light which is redirected more in the upstream director to exit the light pipe without interference from adjacent ribs 50.

The upstream end 24 of the light pipe 22 has a tapered shape in the upstream direction, and generally is structured to collimate the light from the LED light source 18 and direct the light longitudinally downstream generally parallel with the longitudinal axis 15. By the term generally, it is meant that the light follows a path which is within 3° of parallel to the longitudinal axis 15.

The upstream end 24 includes a recess 40 for receiving the LED light source 18. The recess is defined by a slight tapering surface 42 which extends longitudinally and ends at an axially facing surface 44 which is structured as a lens that focuses the light longitudinally downstream. The lens 44, the surface 42 of the recess 40, and the reflective surface 46 of the tapered upstream end 24 all cooperate to direct the light from the LED light source 18 downstream and generally parallel to the longitudinal axis 15. As such, the upstream end is structured to act as a collimater.

The path of light through the LED bulb 20 will now be described with reference to FIG. 3. Rays of light 48 are generated by LED light source 18 and begin at a point of origin 19. Some light 48 follows a path through the lens 44 and is directed longitudinally downstream as shown. The remainder of the light 48 flows through the upstream end 24 and is redirected by recess surface 42 and the upstream end surface 46 longitudinally downstream as shown. The collimated light rays 48 thus flow through the main body 28 of light pipe 22 until they encounter the conical reflector 32.

As the light is generally traveling parallel to the longitudinal axis 15, it also travels parallel to the first surfaces 36 of the conical reflective surface 34, and is thus not immediately redirected. The light 48 will then encounter the second angled surface 38 of the inner surface 34, which redirects the light radially outwardly towards the outer periphery of the light pipe 22. The 45° angle of the second surfaces 38 thus reflects the light 48 along a path that is generally perpendicular to the longitudinal axis 15. Since the ribs 50 are axially aligned with the second angled surfaces 38, the light rays 48 will encounter one of the ribs 50. The upstream and downstream surfaces 52, 54 of the ribs 50 are structured to redirect the light rays 48 in the upstream direction and radially outwardly. It can be seen in the figure that the ribs 50 are structured to redirect the light rays 48 in a manner that the light rays 48 appear to have come from a different origin point 19*a*, which is referred to as a virtual origin point. Thus, the structure of the LED bulb 20 and its light pipe 22 defines a virtual image 19*a* of the LED light source 18. It can be seen in FIG. 4, the light rays 48 exiting the downstream end 26 of the light pipe 22 are directed towards the reflector 12 and its reflective surface 13 for further redirection of the light rays 48 out of the light module 10 and away from the motor vehicle.

Figure 4:
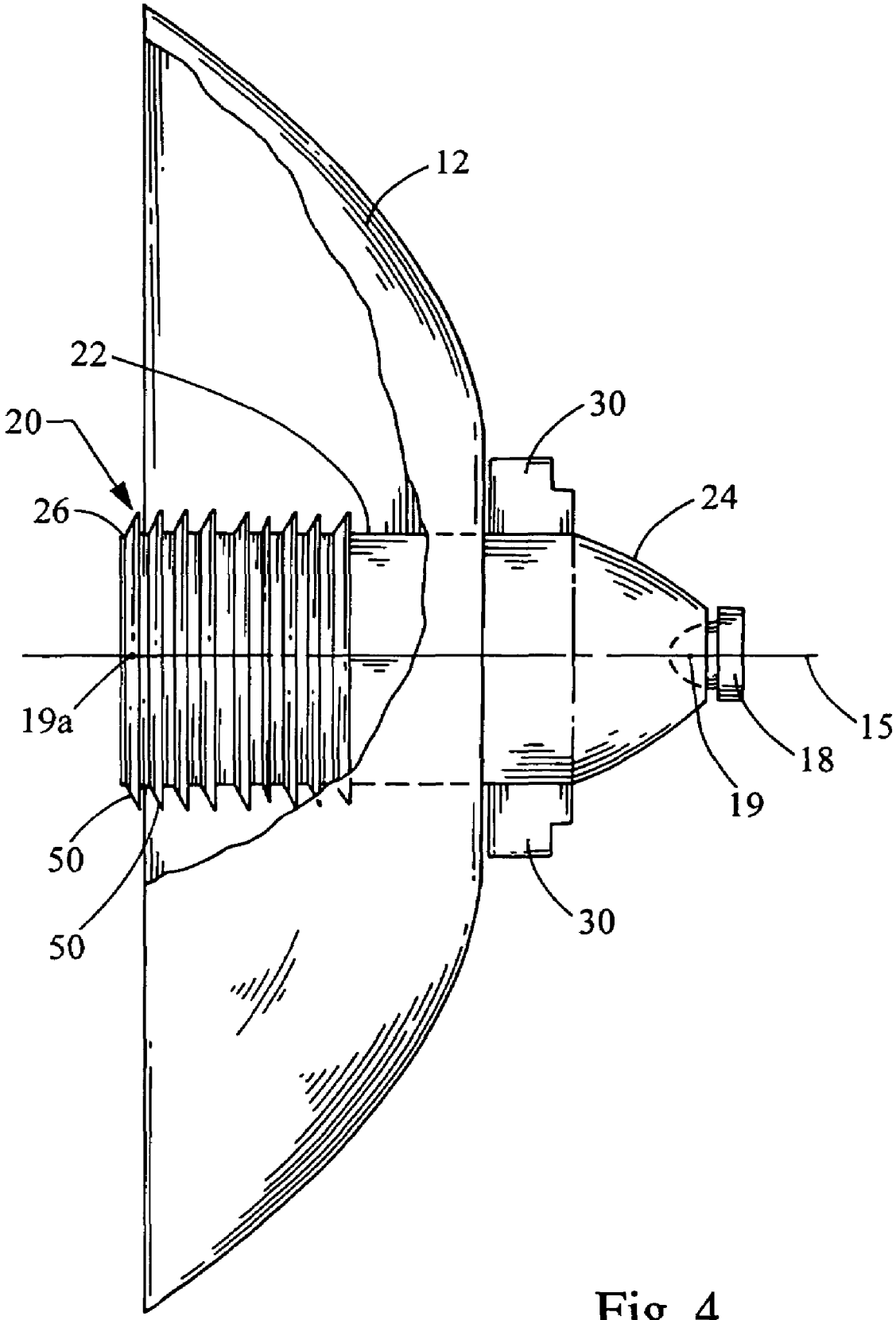
FIG. 4 is a side view of the light module depicted in FIG. 1.

It can also be seen from FIG. 4 that the downstream end 26 of the LED bulb 20 is positioned in front of the reflector 12, while the upstream end 24 extends through the aperture 14 and is positioned behind the reflector 12. Stated another way, the virtual image and focus point 19*a* needs to be positioned in front of the reflector 12, allowing the true LED light source 18 to be positioned outside of the cavity and behind the reflector 12. The virtual image and source point 19*a* is positioned in front of the reflector to direct light toward the reflective surface 13.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A LED bulb for directing light from a LED light source, the LED bulb comprising:

a light pipe receiving light from the LED light source and guiding the light downstream along a longitudinal axis defined by the light pipe;

the light pipe defining a conical reflector redirecting the light radially outwardly; and a plurality of ribs on the outer surface of the light pipe, the ribs redirecting the light to define a virtual image of the LED light source.

2. The LED bulb of claim 1, wherein the conical reflector includes a series of alternating first and second surfaces, the first surfaces oriented generally parallel to the longitudinal axis, the second surfaces angled relative to the longitudinal axis.

3. The LED bulb of claim 2, wherein the ribs are axially aligned with the second surfaces of the conical reflector.

4. The LED bulb of claim 2, wherein the ribs are axially spaced apart from each other a distance corresponding to the axial distance spanned by each first surface.

5. The LED bulb of claim 1, wherein the ribs are axially aligned with the conical reflector.

6. The LED bulb of claim 1, wherein the ribs are tapered.

7. The LED bulb of claim 1, wherein the ribs have a triangular shape.

8. The LED bulb of claim 1, wherein each rib has an upstream face and a downstream face, the downstream face being angled relative to the longitudinal axis.

9. The LED bulb of claim 8, wherein the downstream face is angled in the range of 30 to 89 degrees.

10. The LED bulb of claim 8, wherein the upstream face is generally perpendicular to the longitudinal axis.

11. The LED bulb of claim 1, wherein at least one rib projects radially away from the light pipe a distance shorter than the other ribs project.

12. The LED bulb of claim 11, wherein the at least one rib is one of the upstream ribs.

13. The LED bulb of claim 1, wherein the light pipe is formed to define the conical reflector.

14. The LED bulb of claim 1, wherein the light pipe is molded from a clear optical grade material to define the ribs.

15. The LED bulb of claim 1, wherein the ribs redirect the light upstream to define the virtual image.

16. A light bulb of claim 1, wherein an upstream end of the light pipe includes a recess for receiving the LED light source.

17. The light bulb of claim 16, wherein the upstream end defines a lens adjacent the recess for focusing the light longitudinally downstream.

18. The light bulb of claim 16, wherein the upstream end is structured to collimate light from the LED light source and direct the light longitudinally downstream.

19. A light module for an automobile, the light module comprising:

a reflector defining a cavity and a reflective surface receiving light from in front of the reflector and directing the light outwardly away from the vehicle;

a LED light source;

a LED bulb having an entrance end receiving light from the LED light source and an exit end for directing the light to the reflector, the exit end positioned within the cavity; and the exit end of the LED bulb structured to define a virtual image of the LED light source that is positioned in front of the reflector.

20. The light module of claim 19, wherein the entrance end of the LED bulb is positioned behind the reflector.

21. The light module of claim 19, wherein the LED bulb includes a light pipe having a conical reflector surface and a plurality of ribs on the outer surface of the light pipe, the light pipe receiving light from the LED source and guiding the light downstream along a longitudinal axis defined by the light pipe, the conical reflector surface redirecting the light radially outwardly, and the ribs redirecting the light to define a virtual image of the LED source.

22. The light module of claim 21, wherein the conical reflector surface includes a series of alternating first and second surfaces, the first surfaces oriented generally parallel to the longitudinal axis, the second surfaces angled relative to the longitudinal axis, and wherein the ribs are axially aligned with the second surfaces of the conical reflector surface.

23. The light module of claim 21, wherein each rib has an upstream side and a downstream side, the downstream side being angled relative to the longitudinal axis.

* * * * *